United States Patent [19]

King

[11] Patent Number: 5,044,176

[45] Date of Patent: Sep. 3, 1991

[54] SUPPORT CRADLE FOR EARRING

[75] Inventor: Wendy J. King, Johnston, R.I.

[73] Assignee: Winning Jewelry Company, Inc., Johnston, R.I.

[21] Appl. No.: 468,031

[22] Filed: Jan. 22, 1990

[51] Int. Cl.[5] ..... A44C 7/00

[52] U.S. Cl. ..... 63/12; 63/13

[58] Field of Search ..... 63/12, 1.1, 2, 13, 14.2, 63/DIG. 3

[56] References Cited

U.S. PATENT DOCUMENTS

| | | | |
|---|---|---|---|
| 87,072 | 2/1869 | Rowland | 63/13 X |
| 1,106,388 | 8/1914 | Juergens | 63/13 |
| 2,878,660 | 3/1959 | Schweikert | 63/14.2 |

FOREIGN PATENT DOCUMENTS

| | | | |
|---|---|---|---|
| 2139873 | 11/1984 | United Kingdom | 63/13 |

*Primary Examiner*—Laurie K. Cranmer

*Attorney, Agent, or Firm*—Salter & Michaelson

[57] ABSTRACT

A support cradle for use with a pierced earring is disclosed and includes a body portion having a first leg that terminates in an upper end portion in which an opening is formed, and a second leg that extends upwardly in parallel relation with respect to the first leg and being interconnected thereto by an intermediate curved bight portion, a plurality of openings being formed in the second leg in spaced vertical relation, the openings defining positions of adjustment for receiving a post of the pierced earring therein, the bight portion of the cradle acting to support the wearer's earlobe during wearing of the earring and thereby reducing stress on the wearers earlobe due to the weight of the earring that is mounted thereon.

5 Claims, 1 Drawing Sheet

SUPPORT CRADLE FOR EARRING

BACKGROUND OF THE INVENTION

The present invention relates to a support cradle for use with pierced earrings.

Earrings as mounted on a wearer's earlobe through the use of a penetrating post tend to exert stresses on the wearer's earlobe as caused by the weight of the earring on the earlobe and the length of time the earring is mounted in place thereon. Quite frequently, the stresses as produced by the weight of the earring can be painful to the wearer and in some instances have even resulted in tearing of the opening in the wearer's earlobe through which the post of the earring extends.

Prior to the instant invention, there has not been any special provision for combating the stresses as created by the weight of the earring worn by the wearer, and if such stresses do cause pain or discomfort in the wearer's earlobe, the only solution has been for the wearer to simply remove the earring from her earlobe. Many of the older style of pierced earrings such as illustrated in the Hubash U.S. Pat. No. 511,952 include a loop or bow that interconnects the ornament portion of the earring to a portion that extends in back of the wearer's earlobe and that receives a post therein. However, this type of construction does not in any sense contemplate supporting the wearer's earlobe and is principally utilized for locating the loop or bow in that position that would be inherent from the placement of the piercing post through the wearer's earlobe. In most instances, the underloop or bow of these prior known constructions that interconnects the ornament portion of the earring to a portion that extends in back of the wearer's earlobe is for the purpose of supporting the ornament in place, or in some instances may function as an ornamental portion of the earring. Insofar as applicant is aware, there has not been any prior device that was specifically designed to support the earlobe during the wearing of an earring to alleviate stresses on the earlobe as produced by the weight of the earring.

Other devices known to applicant and that represent the most relevant prior art of which applicant is aware with respect to the subject invention are illustrated in the Smith U.S. Pat. No. 619,444; Shea U.S. Pat. No. 1,576,372; Mittendorf U.S. Pat. No. 2,510,211 and Musillo U.S. Pat. No. 4,372,131. None of these latter named patents show or teach the concept of applicant's invention.

As will be described hereinafter, the subject invention is designed to reduce the stress exerted on the wearer's earlobe when an earring is mounted thereon and also resists tearing of the opening in the earlobe that can be caused by the weight of the earring as carried by the wearer's earlobe.

SUMMARY OF THE INVENTION

The present invention relates to a support cradle for use with a pierced earring, and comprises a body portion having a first leg that terminates in an upper portion in which an opening is formed, the first leg being normally located on the front surface of a wearer's earlobe. A second leg is joined to the first leg by an intermediate curved bight portion and extends upwardly in parallel relation with respect to the first leg. A plurality of openings are formed in the second leg in space vertical relation, the openings defining positions of adjustment for receiving a post of the pierced earring therein. The post of the earring extends through the opening in the first leg and is received in a selected opening in the second leg, the bight portion being received under the earlobe of the wearer to provide a support thereof when the earring is mounted on the earlobe of the wearer.

Accordingly, it is an object of the present invention to provide a support cradle for use with a pierced earring and that reduces the stresses exerted on the wearer's earlobe when the earring is mounted thereon.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE PREFERRED EMBODIMENTS

Figure 1:
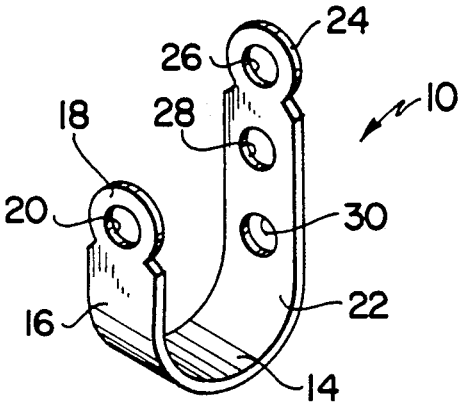
FIG. 1 is a perspective view of one form of the support cradle of the subject invention that is used with a pierced earring.
Figure 2:
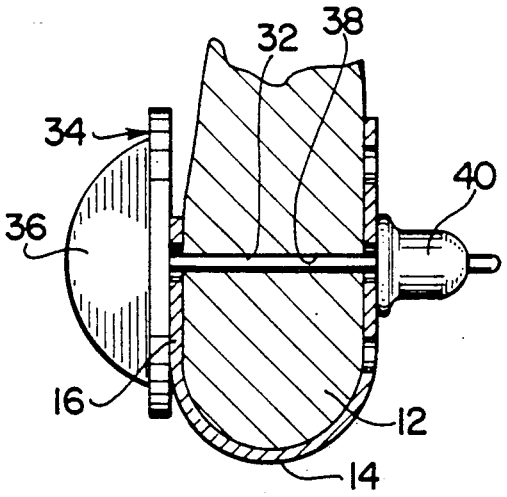
FIG. 2 is a sectional view through a wearer's earlobe showing the location of the support cradle when the earring is mounted in place on the wearer's earlobe.

Referring now to the drawings, and particularly to FIGS. 1 and 2, one form of the support cradle as embodied in the subject invention is illustrated and is generally indicated at 10. The cradle 10 is designed to fit under the wearer's earlobe indicated at 12, as shown in FIG. 2, and for this purpose, includes a U-shaped bight portion 14 to which a shortened front leg 16 is integrally joined. As shown more particularly in FIG. 1, the shortened front leg 16 terminates in a rounded, upper portion 18 in which an opening 20 is formed. As will be described hereinafter, the opening 20 is designed to be aligned with a pierced opening as formed in the wearer's earlobe 12 and receives therethrough a post 32 that is secured to the rear surface of an ornamental portion 36 of an earring generally indicated at 34.

Also integrally joined to the bight portion 14 and located in spaced parallel relation with respect to the leg 16, is a rear, upwardly extending leg 22 that terminates in a rounded upper portion 24. An opening 26 is formed in the upper portion 24, and also formed in the rear leg 22 along the length thereof are vertically extending spaced openings 28 and 30 that provide for adjustment of the cradle on the wearer's earlobe.

In use of the cradle 10, the bight portion 14 is placed beneath the earlobe 12 of the wearer's ear, the post 32 of the earring 34 and on which the ornament 36 is mounted, is inserted through the opening 20 in the front leg 16 of the cradle 10 and then through an opening 38 as formed in the wearer's earlobe 12. Depending upon the length of the earlobe 12 of the wearer, the post 32 is then directed through a selected opening 26, 28 or 30 of the leg 22. As shown in FIG. 2, the opening 28 has been selected as the appropriate opening for a comfortable setting of the post. The post 32 extends through the opening 28 in the leg 22, and the earring 34 and cradle 10 are then locked in place on the wearer's earlobe 12 by a conventional clutch 40. As is apparent, neither of the openings 26 or 30 formed in the rear leg 22 were selected for receiving the post 32 since the bight portion 42 of the cradle as shown in FIG. 2 comfortably supports the wearer's earlobe 12 with the post 32 being received in the selected opening 28.

Figure 3:
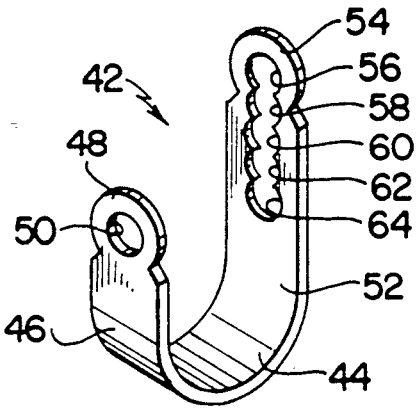
FIG. 3 is a perspective view showing a modified form of the invention.
Figure 4:
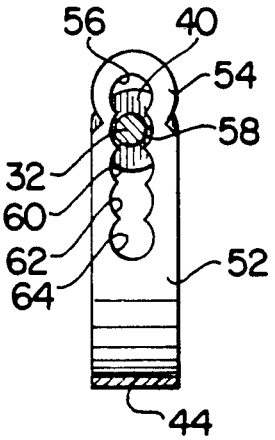
FIG. 4 is a sectional view of the modified form of the invention illustrating a post as mounted for adjustment therein.

It is contemplated that the cradle 10 be stamped in blank form out of a suitable metal material, and the openings 20, 26, 28 and 30 punched in the legs 16 and 22 as required. Thereafter, the cradle 10 is then mechanically formed in the configuration as illustrated in FIGS. 1 and 2. However, it is also contemplated that the cradle be molded of a suitable plastic material to the configuration as required, and the holes formed in the legs in the molding operating. Referring now to FIGS. 3 and 4 such a molded plastic cradle is illustrated and is generally indicated at 42. The cradle 42 is generally similar to the cradle 10 and includes a U-shaped bight portion 44 to which a front shortened upwardly extending leg 46 is joined, the upwardly extending leg 46 having an upper rounded portion 48 joined thereto in which an opening 50 is formed.

One of the features of the cradle 42 as shown in FIGS. 3 and 4 is the convenient adjustability of an earring post therein in conforming the cradle 42 to the wearer's earlobe. In this connection, a vertically extending rear leg 52 is joined integrally to the bight portion 44 and terminates in an upper rounded portion 54 in which an opening 56 is formed. Communicating with the opening 56 are a series of openings 58, 60, 62 and 64 that are disposed in the leg 52 in vertically aligned relation. Each of the openings 56–64 is incompletely closed so that there is communication between each of the adjacent openings as they are located in the leg 52. As shown in FIG. 4, the space or passageway as formed between each of the openings is slightly less than the diameter of an earring post indicated at 32, and since the cradle 42 is formed of a plastic material which does have some deformation, the earring post 32 can be moved into a selected opening in the leg 52 by merely snapping it through the passageways as formed between the adjacent openings. Before locating the post 32 in the opening 58 as shown in FIG. 4, it may have been inserted into an adjacent opening 56 or 60 in adjusting the post 32 in place on the wearer's earlobe after it has been inserted through the opening 50 of the front leg 46 and through the opening 38 in the wearer's earlobe. Thereafter, with the clutch 40 mounted in place on the post 32, it is only necessary for the wearer to exert a slight pressure either upwardly or downwardly on the clutch 40 to cause the post 32 to snap through the restricted space that communicates with the selected opening and the adjacent opening in which the post is initially inserted to locate the post in the desired position.

In use of the modified form of the invention as illustrated in FIGS. 3 and 4, it is understood that the cradle 42 is mounted under the wearer's earlobe 12, with the opening 50 as formed in the leg 46 aligned with the wearer's earlobe 38. The post 32 of the earring 34 is then inserted through the opening 50 and the earlobe opening 38 for insertion into any one of the openings as formed in the rear leg 52. After the clutch 40 is mounted in place on the post 32 to lock the earring on the wearer's earlobe, the post can then be moved upwardly or downwardly by exerting pressure on the post through movement of the clutch 40 to snap the post into the selected opening in the rear leg 52, thereby positioning the cradle 42 in the desired location on the wearer's earlobe.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A support cradle for use with a pierced earring, comprising a body portion having a first leg that terminates in an upper portion having an opening formed therein and that is normally located on the front surface of a wearer's earlobe, a second leg extending upwardly in parallel relation with respect to said first leg and being joined to said first , leg by an intermediate curved bight portion, a plurality of openings formed in said second leg in spaced vertical relation, said openings defining positions of adjustment for receiving a post of said earring therein, said post of said earring extending through the opening in said first leg and through the wearer's earlobe for being received in a selected opening in said second leg, said bight portion being received under the earlobe of the wearer to provide a support thereof when said earring is mounted on the earlobe of the wearer, and thereby reducing stresses on the wearer's earlobe as exerted by the earring mounted thereon.

2. A support cradle as claimed in claim 1, said first leg including an uppermost end that is located above the openings in said first leg, said second leg extending upwardly beyond the uppermost end of said first leg so as to accommodate the openings plurality of as formed therein.

3. A support cradle as claimed in claim 2, said openings in said second leg having continuous communication with each other to enable said post to be moved in a selected opening by snap adjusting the post to the selected opening, wherein said cradle is properly located for supporting the earlobe of the wearer.

4. A support cradle as claimed in claim 3, said cradle being formed of a plastic material that is deformable when pressure is exerted thereon.

5. A support cradle as claimed in claim 4, the communication between the adjacent openings in said second leg being defined by reduced passageways, said passageways having a lateral dimension that is slightly less than the diameter of said post, wherein said post is movable from one opening to an adjacent opening in said second leg by snapping it through a reduced passageway, the deformable plastic material from which said cradle is formed providing for the snap movement of said post through said passageways.

* * * * *